US006656018B1

(12) United States Patent
Hsu et al.

(10) Patent No.: US 6,656,018 B1
(45) Date of Patent: Dec. 2, 2003

(54) POLISHING PADS USEFUL IN CHEMICAL MECHANICAL POLISHING OF SUBSTRATES IN THE PRESENCE OF A SLURRY CONTAINING ABRASIVE PARTICLES

(75) Inventors: Oscar K. Hsu, Chelmsford, MA (US); Jean K. Vangsness, Stow, MA (US); Scott C. Billings, Kingston, NH (US); David S. Gilbride, Lowell, MA (US)

(73) Assignee: Freudenberg Nonwovens Limited Partnership, Durham, NC (US)

( * ) Notice: Subject to any disclaimer, the term of this patent is extended or adjusted under 35 U.S.C. 154(b) by 0 days.

(21) Appl. No.: 09/545,982

(22) Filed: Apr. 10, 2000

Related U.S. Application Data

(60) Provisional application No. 60/129,048, filed on Apr. 13, 1999.

(51) Int. Cl.[7] ..... B24B 1/00

(52) U.S. Cl. ..... 451/41; 451/42; 451/285; 51/294

(58) Field of Search ..... 451/41, 42, 287, 451/288, 296, 526; 51/294, 295, 389

(56) References Cited

U.S. PATENT DOCUMENTS

| | | | | | |
|---|---|---|---|---|---|
| 3,607,159 | A | * | 9/1971 | Haywood | 51/295 |
| 4,255,164 | A | * | 3/1981 | Butzke et al. | 51/295 |
| 5,346,516 | A | * | 9/1994 | Alkhas et al. | 51/295 X |
| 5,578,098 | A | * | 11/1996 | Gagliardi et al. | 51/295 |
| 5,624,304 | A | * | 4/1997 | Pasch et al. | 451/287 |
| 5,632,668 | A | * | 5/1997 | Lindholm et al. | 451/42 |
| 5,645,736 | A | | 7/1997 | Allman | 216/89 |
| 5,702,292 | A | * | 12/1997 | Brunelli et al. | 451/287 X |
| 5,725,417 | A | | 3/1998 | Robinson | 451/56 |
| 5,879,226 | A | | 3/1999 | Robinson | 451/287 |
| 5,910,471 | A | * | 6/1999 | Christianson et al. | 51/295 |
| 5,976,000 | A | | 11/1999 | Hudson | 451/534 |
| 6,254,460 | B1 | * | 7/2001 | Walker et al. | 451/287 |

FOREIGN PATENT DOCUMENTS

| | | |
|---|---|---|
| EP | 0 845 328 A2 | 6/1998 |
| JP | 02088165 A | 3/1990 |
| JP | 09059395 A | 3/1997 |
| JP | 10225864 A | 8/1998 |

* cited by examiner

*Primary Examiner*—Joseph J. Hail, III
*Assistant Examiner*—Anthony Ojini
(74) *Attorney, Agent, or Firm*—Weingarten, Schurgin, Gagnebin & Lebovici LLP

(57) ABSTRACT

A polishing pad for polishing semiconductors and other planar substrates in the presence of a slurry comprising abrasive particles and a dispersive agent is disclosed. The polishing pad includes a soluble component, preferably fibrous, within a polymer matrix component. The fibrous component includes fibers soluble in the slurry sufficiently to provide a void structure in the polishing surface of the pad. The void structure enhances the polishing rate and uniformity by increasing the mobility of the abrasive particles while reducing scratching of the polished surface. Additives that further enhance polishing and/or assist in the removal of residues generated during polishing, such as surfactants and removers, are optionally incorporated in the fibrous substance or topographically coated on the fibrous substance.

33 Claims, 2 Drawing Sheets

POLISHING PADS USEFUL IN CHEMICAL MECHANICAL POLISHING OF SUBSTRATES IN THE PRESENCE OF A SLURRY CONTAINING ABRASIVE PARTICLES

CROSS REFERENCE TO RELATED APPLICATIONS

This application claims the benefit under 35 U.S.C. §112 (e) of U.S. Provisional Application No. 60/129,048, filed Apr. 13, 1999, the entire disclosure of which is incorporated herein by reference.

STATEMENT REGARDING FEDERALLY SPONSORED RESEARCH OR DEVELOPMENT

N/A

BACKGROUND OF THE INVENTION

Semiconductor devices are formed from a flat, thin wafer of a semiconductor material, such as silicon. The wafer must be polished to achieve a sufficiently flat surface with no or minimal defects. A variety of chemical, electrochemical, and chemical mechanical polishing techniques are employed to polish the wafers.

In chemical mechanical polishing ("CMP"), a polishing pad made of a urethane material is used in conjunction with a slurry to polish the wafers. The slurry comprises abrasive particles, such as aluminum oxide, cerium oxide, or silica particles, dispersed in an aqueous medium. The abrasive particles generally range in size from 100 to 200 nm. Other agents, such as surface acting agents, oxidizing agents, or pH regulators, are typically present in the slurry.

The urethane pad is textured, such as with channels or perforations, to aid in the distribution of the slurry across the pad and wafer and removal of the slurry and grindings therefrom. In one type of polishing pad, hollow, spherical microelements are distributed throughout the urethane material. As the surface of the pad is worn away through use, the microelements provide a continually renewable surface texture.

SUMMARY OF THE INVENTION

The present invention relates to a polishing pad for polishing a substrate in the presence of a slurry comprising abrasive particles and a dispersive agent. The polishing pad uses a component, preferably fibrous, within a polymer matrix component. The fibrous component is soluble in the slurry, such that fibers present at the polishing surface of the pad dissolve upon contact with the slurry to provide a void structure on the polishing surface. The void structure provides pores that enhance the polishing rate and uniformity by increasing the mobility of the abrasive particles in the slurry while reducing scratching of the polished surface. The pores act as temporary storage areas for the abrasive particles, thus reducing highly frictional contact between the abrasive particles and the polished surface.

More particularly, the polishing pad comprises a first layer having a polishing surface and a backing surface. The first layer is formed of the fibrous component in the polymer matrix component. The fibrous component comprises fibers soluble in the slurry sufficiently to provide a void structure in the polishing surface. The solvent may be either the dispersive phase of the abrasive particles or another material added to the slurry during polishing. The polishing pad also comprises a backing structure comprising an adhesive layer or layers fixed to the backing surface of the first layer, so that the polishing pad may be affixed to a tool.

The nature of the void structure on the polishing surface of the polishing pad is determined by parameters such as the rate of dissolution of the fibers in the solvent, the ratio of fibers to matrix, the shape and size of the fibers, the orientation of the fibers, the density of the fibers both in area and volume, and the presence and amount of any insoluble fibers. Suitable fibers for semiconductor wafer polishing, which are soluble in an aqueous slurry, include polyvinyl alcohol and maleic acid and their derivatives or copolymers.

Additives that further enhance polishing and/or assist in the removal of residues generated during polishing may be incorporated in the fibrous component or be applied as a topographic coating to the fibrous component. These additives are released at a controlled rate during polishing.

The polishing pad applies to a diversity of applications including semiconductor wafer polishing known as chemical mechanical polishing (CMP) and other polishing applications for metal, ceramic, glass, wafers, hard disks etc., that use a liquid medium to carry and disperse the abrasive particles.

DESCRIPTION OF THE DRAWINGS

The invention will be more fully understood by reference to the following detailed description when considered in conjunction with the accompanying drawings, in which.

DETAILED DESCRIPTION OF THE INVENTION

Figure 1:
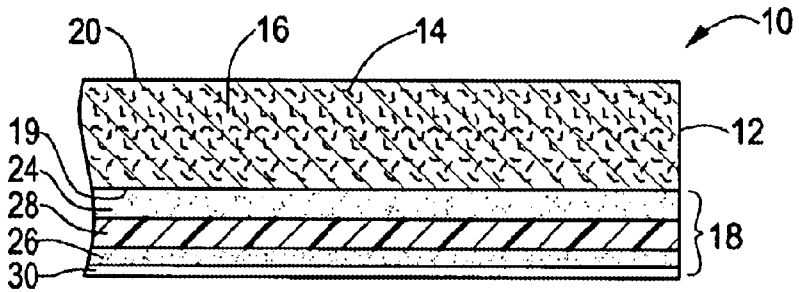
FIG. 1 is a partial cross-sectional view of a polishing pad in accordance with the invention.
Figure 5:
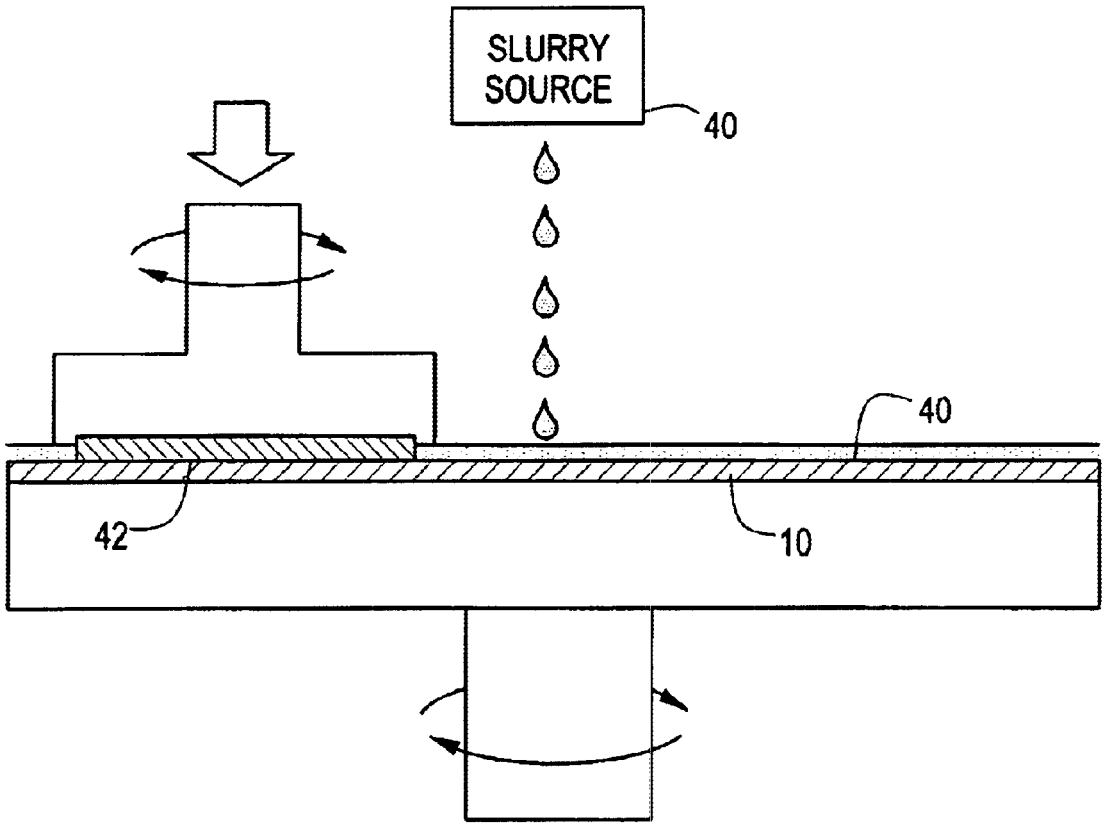
FIG. 5 is a schematic illustration of a polishing pad in accordance with the invention in conjunction with a tool and polishing slurry and substrate to be polished.

The present invention relates to a polishing pad 10 that is utilized in conjunction with a polishing slurry 40 comprising a liquid medium that carries and disperses abrasive particles between the polishing pad and the surface 42 being polished. See FIG. 5. Referring to FIG. 1, the preferred embodiment of the polishing pad incorporates a layer 12 of a composite polishing material comprising a soluble fibrous component 14 encapsulated or embedded in a polymeric matrix component 16. The fibrous component is soluble in water or another solvent present in the polishing slurry at a rate sufficient to leave voids on the polishing surface of the pad. The solvent may be the dispersive phase of the abrasives or may be another material added to the slurry. In semiconductor wafer polishing, the slurry is typically an aqueous medium, and the solvent is thus water. Useful polymeric materials for the matrix component include most common structural polymers, such as polyurethanes, polyacrylates, polystyrenes, polyimides, polyamides, polycarbonates, and epoxies. Other polymers that have a rigidity sufficient to support the fibrous component may be used. An adhesive backing structure 18 is attached to the underside or backing surface 19 of the composite polishing material layer 12, so that the polishing pad may be affixed to a tool.

Figure 3:
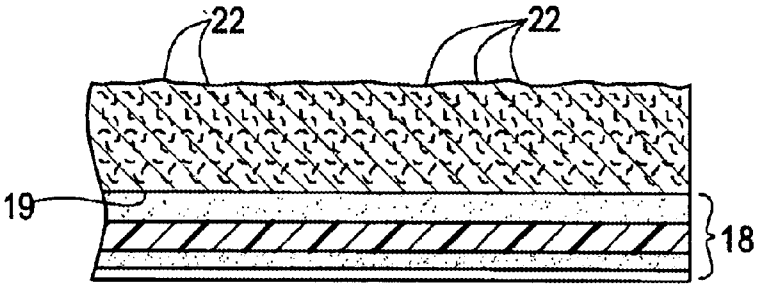
FIG. 3 is a partial cross-sectional view along line B—B of the polishing pad of FIG. 2.
Figure 2:
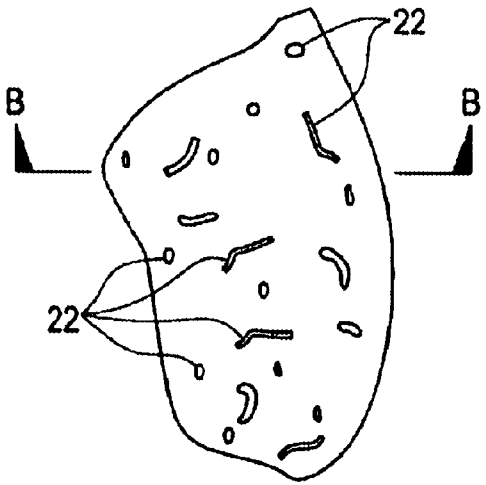
FIG. 2 is a partial top view of the polishing pad of FIG. 1 during use.

Before use, the surface 20 of the polishing material is smooth, as illustrated in FIG. 1. Although fibers are exposed at the surface, no dissolution has occurred to roughen the surface. Once the solvent contacts the fibrous component at the surface, the fibrous component begins to dissolve, forming a void structure of pores 22 in the surface, as illustrated schematically in FIGS. 2 and 3. The pores on the surface of the polishing substance enhance the polishing rate and uniformity by increasing the mobility of the abrasives while reducing scratching of the polished surface. The pores act as temporary storage areas for the abrasive particles, thus reducing highly frictional contact between the abrasive particles and the polished surface.

The fibrous component may be formed of any suitable soluble fiber material, such as polyvinyl alcohol (PVAc), maleic acid, polyacrylic acid, various polysaccharides and gums, or derivatives of these materials. Copolymers of these polymers may also be used. The particular fiber material is selected depending on the particular solvent to be used and the intended polishing application. In semiconductor wafer polishing, the slurry typically uses an aqueous medium as the dispersive phase for the abrasive particles. Thus, water is typically the preferred solvent for this application, and PVAc, copolymers of PVAc, maleic acid, and derivatives of these materials are suitable for the fibrous component. Other solvents and fiber materials may be used, however, depending on the application.

For semiconductor wafer polishing, the fiber material is preferably chosen such that the rate of dissolution of the fibrous component in the dissolving medium is as fast as possible. Preferably, the fiber component dissolves as soon as it contacts the dissolving medium, so that no delay is needed before polishing can begin. For example, PVAc and maleic acid and their derivatives dissolve suitably quickly in water. The rate of dissolution can be controlled by the particular material chosen. For example, the salt of a compound can render the compound more or less hydrolyzable by an aqueous medium. Polymerization can also be used to control the dissolution rate. For example, increasing the molecular weight can slow the rate of dissolution.

The fibrous material may be prepared by any suitable process, such as by nonwoven techniques, for example, chemical, mechanical, or thermal bonding of fibers or the laying down of a loose mat of fibers or filaments, as well as by weaving or knitting techniques, as would be known in the art. A nonwoven material is usually preferred, because it gives a more random orientation of pore structure. The orientation of the fibers relative to the polishing surface may be controlled to affect the size of the pores on the polishing surface. If the fibers are oriented predominantly parallel to the surface, the resulting void structure will have more channel-shaped or elongated pores. If the fibers are oriented predominantly orthogonally to the surface, the resulting void structure will have more pores of a smaller diameter. A greater density of pores over the polishing surface can be achieved with an orthogonal orientation of the fibers. Continuous fibers or cut fibers, having a fiber length of 0.5 mm to 15 mm, may be used. Cut fibers provide more fiber ends, resulting in a void structure with more holes.

The diameters of the fibers are selected such that the pore size after dissolution is complementary to the particle size of the abrasive particles in the slurry, which typically range in size from 100 to 200 nm. If the pores are too large, the slurry particles may stagnate in the pores, resulting in loss of their polishing effect. Also the location of the particles cannot be adequately controlled, leading to nonuniformities in polishing. If the pores are too small, the particles may become stuck in the pores, leading to scratching of the substrate to be polished. A fiber diameter range of 20 to 200 $\mu$m, and preferably 30 to 100 $\mu$m, has been found to provide a suitable range of pore sizes for the typical range of abrasive particles used in CMP slurries.

The ratio of the fiber component to the matrix component can vary from 90% fiber/10% matrix to 10% fiber/90% matrix by volume. A higher fiber component yields a softer, more compressible polishing material that is more suitable for polishing softer features, such as aluminum, tungsten, or copper wiring present on the substrate. A polishing material with a fiber content as high as 90% has a very fibrous structure, with fibers that are incompletely coated with the matrix material. A higher matrix component yields a harder polishing material that is more suitable for polishing a harder substrate, such as a silicon oxide layer. A polishing material with a fiber content as little as 10% is very solid and less compressible.

The composite material layer may also have a layered structure, such as an upper layer having a higher ratio of fibers to matrix and a lower layer having a lower ratio of fibers to matrix. The upper layer provides mobility of the slurry particles on the surface while the lower layer provides greater rigidity to enhance planarity. In a variant, the lower layer may have no fibers. In another embodiment, a gradation of the ratio of fibers to matrix or of other properties may be provided from the polishing surface to the backing surface.

The fibrous component may also include some insoluble fiber material. The insoluble fiber acts as a sweep, isolating the hard surface of the matrix component from scratching the substrate to be polished. The amount of insoluble fiber may range up to 90% by mass.

In another embodiment, the soluble material may be particulate in nature, such as a powder. In this case, the powder dissolves at the surface upon contact with the solvent to form a void structure on the surface. In the interior of the pad, the powder provides a solid structure.

The thickness of the layer 12 of the composite polishing material ranges from 0.005 inch to 0.150 inch. The thickness of the layer determines the life of the pad. The thickness also determines physical properties of the pad. For example, a thicker layer is stiffer and more resistant to bending. The actual thickness selected depends on the particular application.

The backing structure 18 provides a medium for attaching the polishing pad to a tool and adds compressibility to complement the rigidity of the composite material layer. The rigidity of the composite material layer provides planarity on a small scale, that is, over a small region of the substrate to be polished. The compressibility of the backing structure provides uniformity of pressure over the entire substrate surface, for example over the 8 inch or 12 inch diameter of a semiconductor wafer. This ensures uniformity of polishing if, for example, the substrate is concavely or convexly curved or otherwise irregular.

In one embodiment, the backing structure 18 includes two layers 24, 26 of adhesive with a compressible structural layer 28 therebetween. The thickness of the backing structure ranges from 0.005 to 0.070 inch. The first adhesive layer is bonded to the composite polishing material and is selected to provide a strong bond to the composite material layer. The second adhesive layer allows the entire pad to be fixed to a tool and is selected to provide good cohesion, so that the pad may be removed from the tool without leaving a residue on the tool. Any suitable adhesive material may be used, such as acrylic or butyl rubber types, a hot melt adhesive containing an acrylic, polyethylene, polyvinyl, polyester, or nylon, or a mixture thereof. The second adhesive layer is protected by a release liner 30 that is removed prior to affixing the polishing pad to a tool.

The structural layer 28 is made of polymeric materials such as a film of polyester, or a foam of polyethylene, polystyrene, or derivatives or copolymers thereof. Other materials, such as extruded polyethylene or polystyrene sheets or a nonwoven polymer layer, may be used. The thickness of the structural layer is nominally 0.005 to 0.100 inch.

Figure 4:
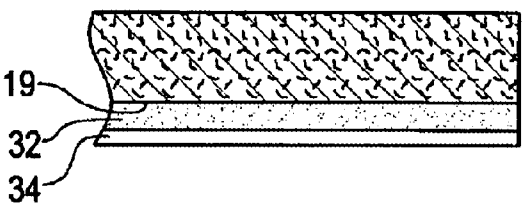
FIG. 4 is a partial cross-sectional view of a further embodiment of a polishing pad in accordance with the invention.

In a further embodiment, illustrated in FIG. 4, the backing structure is composed of a single adhesive layer 32 affixed to the underside of the polishing material layer. For example, if the composite material layer has a high fiber content, a single adhesive layer may provide sufficient compressibility for the pad. The single adhesive layer is covered by a release liner 34.

During polishing of a semiconductor wafer, the polymeric material of the matrix component shears or flows and forms a film over the surface of the pad, clogging the pores and diminishing the polishing effectiveness of the pad. Thus, after polishing a wafer, the surface of the pad is conditioned or dressed by diamond polishing. The rate of dissolution of the fibrous component is preferably greater than the rate of wear of the matrix component caused by this dressing step. The polishing surface is rejuvenated and renewed as the matrix component is depleted or wears down, because new areas of the fibrous component are exposed and dissolved, thus forming new pores for enhanced polishing action.

Other additives, such as surfactants and removers to enhance the stability of the residue particles and prevent them from redepositing onto the polished surface of the substrate, may be included in the composite material layer. These additives may be incorporated into the fibrous component, for example, by doping the polymeric material of the fiber before the fiber is extruded, or may be applied as a topographic coating to the fibers. In this way, the additives are released at a controlled rate during polishing. Typical additives contain, for example, silicon oil or fluorocarbon type release agents or other agents that are known additives to polishing slurries.

The polishing pad of the present invention is particularly suitable for the chemical mechanical polishing of semiconductor wafers. The polishing pad may, however, be used for polishing other substrates, such as metal, ceramic, glass, wafers, or hard disks, in polishing applications that use a liquid medium to carry and disperse abrasive particles between the polishing pad and the substrate being polished. Having described preferred embodiments of the invention it will now become apparent to those of ordinary skill in the art that other embodiments incorporating the concepts of the present invention may be used. Accordingly, it is submitted that the invention should not be limited by the described embodiments but rather should only be limited by the spirit and scope of the appended claims.

What is claimed is:

1. A work pad for polishing a substrate in the presence of a slurry comprising abrasive particles and a dispersive agent, comprising:

a working structure having a work surface and a backing surface, the working structure comprising a two-component system, a first component comprising a fibrous component, a second component comprising a polymer matrix component, the fibrous component distributed throughout at least an upper portion of the working structure, the fibrous component comprising fibers soluble in the slurry to provide a void structure in the work surface.

2. The work pad of claim 1, wherein the soluble fibers are soluble in the dispersive agent of the slurry.

3. The work pad of claim 1, wherein the slurry is an aqueous slurry and the soluble fibers are soluble in water.

4. The work pad of claim 1, wherein the soluble fibers have a diameter selected to allow mobility to particles of the abrasive within the void structure.

5. The work pad of claim 1, wherein the soluble fibers have a diameter ranging from 20 to 200 $\mu$m.

6. The work pad of claim 1 wherein the soluble fibers are made of polyvinyl alcohol, derivatives of polyvinyl alcohol, copolymers of polyvinyl alcohol, polyacrylic acid, derivatives of polyacrylic acid, copolymers of polyacrylic acid, polysaccharides, derivatives of polysaccharides, copolymers of polysaccharides, gums, derivatives of gums, copolymers of gums, maleic acid, derivatives of maleic acid, or copolymers of maleic acid.

7. The work pad of claim 1, wherein said fibrous structure is a nonwoven material, a woven material, or a knit material.

8. The work pad of claim 1, wherein the fibers are oriented with a plurality of the fibers parallel to the work surface.

9. The work pad of claim 1, wherein the fibers are oriented with a plurality of the fibers orthogonal to the work surface.

10. The work pad of claim 1 wherein the soluble fibers are cut fibers.

11. The work pad of claim 1, wherein the soluble fibers are continuous fibers.

12. The work pad of claim 1, wherein the soluble fibers dissolve at a rate greater than a rate of wearing down of the matrix component.

13. The work pad of claim 1, wherein the polymeric matrix component is made of a polymer having sufficient rigidity to support the fibrous component.

14. The work pad of claim 1 wherein the polymeric matrix component is made of a polyurethane, a polyacrylate, a polystyrene, a polyimide, a polyamide, a polycarbonate, or an epoxy.

15. The work pad of claim 1, wherein the working structure has a ratio of fibrous component to matrix component of 10%/90% to 90%/10% by volume.

16. The work pad of claim 1, wherein the working structure has a thickness ranging from 0.005 inch to 0.150 inch.

17. The work pad of claim 1, wherein the working structure further includes a surfactant or removal additive.

18. The work pad of claim 17, wherein the additive is incorporated within the fibers of the fibrous component.

19. The work pad of claim 17, wherein the additive is topographically coated onto the fibers of the fibrous component.

20. The work pad of claim 1, wherein the fibrous component further includes fibers insoluble in the slurry.

21. The work pad of claim 20, wherein the insoluble fibers comprise up to 90% by mass of the fibrous component.

22. The work pad of claim 1, further comprising a backing structure comprising an adhesive layer fixed to the back surface of the working structure.

23. The work pad of claim 22, wherein the backing structure further comprises two layers of adhesive with a compressible structural layer therebetween.

24. A process of polishing a substrate using a work pad, comprising:

providing a work pad comprising a working structure having a work surface and a backing surface, the working structure comprising a two-component system, a first component comprising a fibrous component, a second component comprising a polymer matrix component, the fibrous component distributed throughout at least an upper portion of the working structure, the fibrous component comprising fibers soluble in a slurry to provide a void structure in the work surface;

providing a substrate to be polished;

providing the slurry comprising abrasive particles and a dispersive agent; and polishing the substrate with the slurry using the work pad.

25. The process of claim 24, wherein the substrate comprises a semiconductor wafer.

26. The process of claim 24, wherein the substrate comprises metal.

27. The process of claim 24, wherein the substrate comprises ceramic.

28. The process of claim 24, wherein the substrate comprises glass.

29. The process of claim 24, wherein the substrate comprises a hard disk.

30. A work pad for polishing a substrate in the presence of a slurry comprising abrasive particles and a dispersive agent, comprising:

a working structure having a work surface and a backing surface, the working structure formed of a soluble component in a polymer matrix component, the soluble component comprising a fibrous material soluble in the slurry to form a void structure in the work surface, the fibrous material comprising a nonwoven material, the polymer matrix component providing a non-compliant continuum in the interior of the working structure; and a backing structure comprising an adhesive layer fixed to the backing surface of the working structure.

31. The work pad of claim 30, wherein the slurry is an aqueous slurry and the soluble component is soluble in water.

32. A work pad for polishing a substrate in the presence of a slurry comprising abrasive particles and a dispersive agent, comprising:

a working structure having a work surface and a backing surface, the working structure formed of a soluble component in a polymer matrix component, the soluble component comprising a fibrous material soluble in the slurry to form a void structure in the work surface, the fibrous material comprising a woven material, the polymer matrix component providing a non-compliant continuum in the interior of the working structure; and a backing structure comprising an adhesive layer fixed to the backing surface of the working structure.

33. A work pad for polishing a substrate in the presence of a slurry comprising abrasive particles and a dispersive agent, comprising:

a working structure having a work surface and a backing surface, the working structure formed of a soluble component in a polymer matrix component, the soluble component comprising a fibrous material soluble in the slurry to form a void structure in the work surface, the fibrous material comprising a knit material, the polymer matrix component providing a non-compliant continuum in the interior of the working structure; and a backing structure comprising an adhesive layer fixed to the backing surface of the working structure.

* * * * *